US005771608A

United States Patent [19]

Peterson

[11] Patent Number: 5,771,608

[45] Date of Patent: Jun. 30, 1998

[54] SHOE WITH ANKLE STRAP PROTECTOR

[75] Inventor: William R. Peterson, Granada Hills, Calif.

[73] Assignee: K-Swiss Inc., Chatsworth, Calif.

[21] Appl. No.: 715,089

[22] Filed: Sep. 17, 1996

[51] Int. Cl.[6] ..... A43B 7/20; A43C 11/00

[52] U.S. Cl. ..... 36/89; 36/50.1

[58] Field of Search ..... 36/89, 90, 50.1, 36/45, 115, 140, 128, 170

[56] References Cited

U.S. PATENT DOCUMENTS

| | | | |
|---|---|---|---|
| 1,155,506 | 10/1915 | Osaki | 36/89 X |
| 1,328,333 | 1/1920 | Mann | 36/50.1 |
| 1,572,213 | 2/1926 | Lucas | 36/170 |
| 2,143,556 | 1/1939 | Hodaly | 36/50.1 X |
| 3,327,410 | 6/1967 | Park, Sr. et al. . | |
| 4,547,981 | 10/1985 | Thais et al. | 36/89 |
| 4,577,419 | 3/1986 | Chassaing | 36/89 |
| 4,676,011 | 6/1987 | O'Rourke et al. | 36/89 |
| 4,776,111 | 10/1988 | Crowley | 36/89 |
| 4,793,075 | 12/1988 | Thatcher | 36/50.1 X |
| 4,811,498 | 3/1989 | Barret | 36/89 X |
| 4,922,630 | 5/1990 | Robinson | 36/89 |
| 4,989,350 | 2/1991 | Bunch et al. | 36/89 |
| 5,109,613 | 5/1992 | Van Dyke | 36/89 |
| 5,117,568 | 6/1992 | Mitsui | 36/54 |
| 5,175,947 | 1/1993 | Parracho | 36/89 |
| 5,243,772 | 9/1993 | Francis et al. | 36/114 |
| 5,269,078 | 12/1993 | Cochrane | 36/93 |
| 5,379,530 | 1/1995 | Bell et al. | 36/89 |
| 5,408,761 | 4/1995 | Gazzano | 36/88 |
| 5,430,959 | 7/1995 | Mitsui | 36/88 |

FOREIGN PATENT DOCUMENTS

| | | | |
|---|---|---|---|
| 765616 | 6/1934 | France | 36/89 |
| 2699795 | 7/1994 | France | 36/45 |
| 13090 | of 1902 | United Kingdom | 36/128 |
| 275 | of 1903 | United Kingdom | 36/128 |

*Primary Examiner*—B. Dayoan

*Attorney, Agent, or Firm*—Oblon, Spivak, McClelland, Maier & Neustadt, P.C.

[57] ABSTRACT

A shoe having a support strap assembly which is advantageous in providing improved support and/or improved balance of the shoe, to assist in preventing ankle injury or in reducing the severity of an ankle injury. In a preferred form of the invention, an upper strap assembly extends adjacent a top region of the shoe, and side strap assemblies extend from the upper strap assembly and along each side of the shoe. With the arrangement, if the foot is tilted, the strap on the side of the foot opposite to the direction of tilting not only provides support to the wearer, but also can provide feedback to the wearer to inform the wearer of an improper foot position and thereby assist the wearer in returning the foot to a proper position. In a disclosed embodiment, the side strap assemblies extend in front of the ankle, and meet with a sole of the shoe in an arch region of the shoe, so that the support strap assemblies provides a stirrup-like balanced arrangement.

29 Claims, 3 Drawing Sheets

SHOE WITH ANKLE STRAP PROTECTOR

BACKGROUND OF THE INVENTION

1. Field of the Invention

The invention relates to shoes, such as athletic shoes, and particularly to an athletic shoe having a support strap assembly which assists in maintaining a balanced foot posture, to thereby assist in avoiding or minimizing injury.

2. Discussion of Background

Athletic shoes having ankle protecting devices are known. One such arrangement is discloses in U.S. Pat. No. 4,922,630 to Robinson. In this arrangement, a strap is provided on only the lateral side of the upper, and extends over the lateral malleolus and ankle region of the foot. The strap is tightened so that ankle inversion is prevented, to avoid injuries associated with ankle inversion. With this arrangement, since ankle inversion is prevented by restricting movement as a result of the tightness of the strap, the strap extends over the ankle and lateral malleolus (or the pivot point of the ankle), so that other forms of movement which can be associated with an athletic activity are not encumbered. However, the Robinson arrangement suffers from a number of shortcomings. For example, the strap assembly of Robinson requires a number of adjusting devices, to ensure that the lateral strap and an upper strap (to which the lateral strap is coupled) are maintained taught. With this arrangement, if the straps are not sufficiently tight, the injury prevention effect is diminished. If the straps are tightened excessively, circulation to the foot can be restricted, or the foot could be biased toward an unnatural position, possibly increasing the risk of injury. In addition, the numerous adjusting devices can be inconvenient, and the associated number of straps having free ends can increase the possibility that a strap will become caught or otherwise trip the wearer.

Accordingly, a shoe having an improved support strap assembly support is desired, which preferably assists in avoiding injuries and/or in minimizing the severity of injuries.

SUMMARY OF THE INVENTION

It is an object of the present invention to provide a novel shoe which includes a support strap assembly for assisting in the prevention of injuries or in minimizing the severity of injuries.

It is a further object of the invention to provide a shoe having a support strap assembly in which the number of adjusting devices and strap free ends are minimized.

These and other objects and advantages are achieved in accordance with the present invention by a shoe having a support strap assembly in which first and second side straps or side strap assemblies extend from an upper strap assembly, with the first and second side straps assisting the wearer in maintaining proper foot posture, to prevent or reduce the possibility of injury. In a particularly preferred form of the invention, the side straps extend to the sole portion of the shoe and meet the sole portion of the shoe in an arch region of the shoe.

With the strap assembly of the present invention, by providing straps on both sides of the shoe, in addition to providing additional support to the wearer, the straps provide biofeedback to the wearer so that if the foot becomes canted (inversion or eversion) this positioning is more readily sensed by the wearer and the wearer can correct the foot posture, hopefully before bearing weight upon the foot so that injury is prevented or the severity of any injury can be reduced. This biofeedback effect can occur consciously or subconsciously as the wearer is performing an athletic activity.

In accordance with another aspect of the present invention, the side strap assemblies extend through slots disposed in the sides of the upper of the shoe, thereby ensuring proper positioning of the side strap assemblies. In addition, in accordance with a further preferred aspect, the side straps extend from an upper strap assembly, and are connected to the upper strap assembly, for example, by a buckle member. Preferably, the buckle member has a width which is greater than a width of the slots of the upper, so that the buckle member restricts movement of the side straps with respect to the slots, thereby avoiding the need for numerous adjusting means or fasteners for the side straps and reducing the possibility that the support effect will be diminished by improper adjustment or loosening of such fasteners.

The upper strap assembly is disposed adjacent an opening of the shoe (i.e., the opening through which a foot is inserted as the shoe is placed upon a wearer), and can be either disposed above the shoe opening (e.g., on the wearer's leg for a lowtop shoe) or at the top of the upper (e.g., just below the opening of the shoe in a hightop shoe). In a particularly preferred form of the invention, a channel is disposed in the upper of the shoe through which the upper strap assembly extends, thereby further assisting in proper positioning of the support strap assembly, and also assisting in limiting movement of the side straps without requiring an excessive number of adjusting elements.

Thus, with the present invention, a support and biofeedback effect is provided to assist the wearer in maintaining proper foot position/posture. The present invention further provides a reliable and relatively simply support strap arrangement in which the number of fasteners is minimized. In the disclosed embodiment, only a single fastener need be fastened or unfastened for placement of the shoe upon a foot or removal of the shoe from the foot.

BRIEF DESCRIPTION OF THE DRAWINGS

A more complete appreciation of the invention and many of the attendant advantages thereof will be readily obtained as the same becomes better understood by reference to the following detailed description, particularly when considered in conjunction with the accompanying drawings, wherein.

DESCRIPTION OF THE PREFERRED EMBODIMENT

Figure 1:
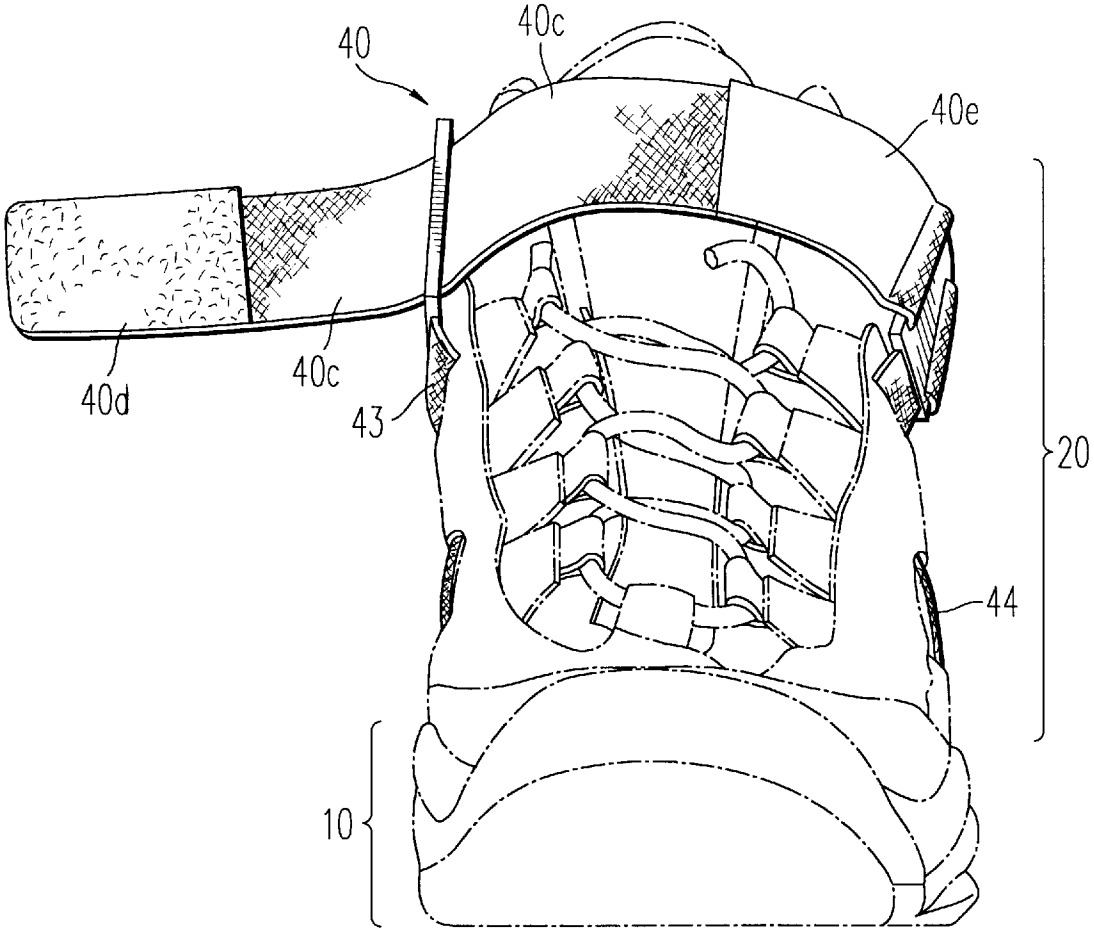
FIG. 1 is a front view of a shoe having a support strap assembly in accordance with the present invention.
Figure 2:
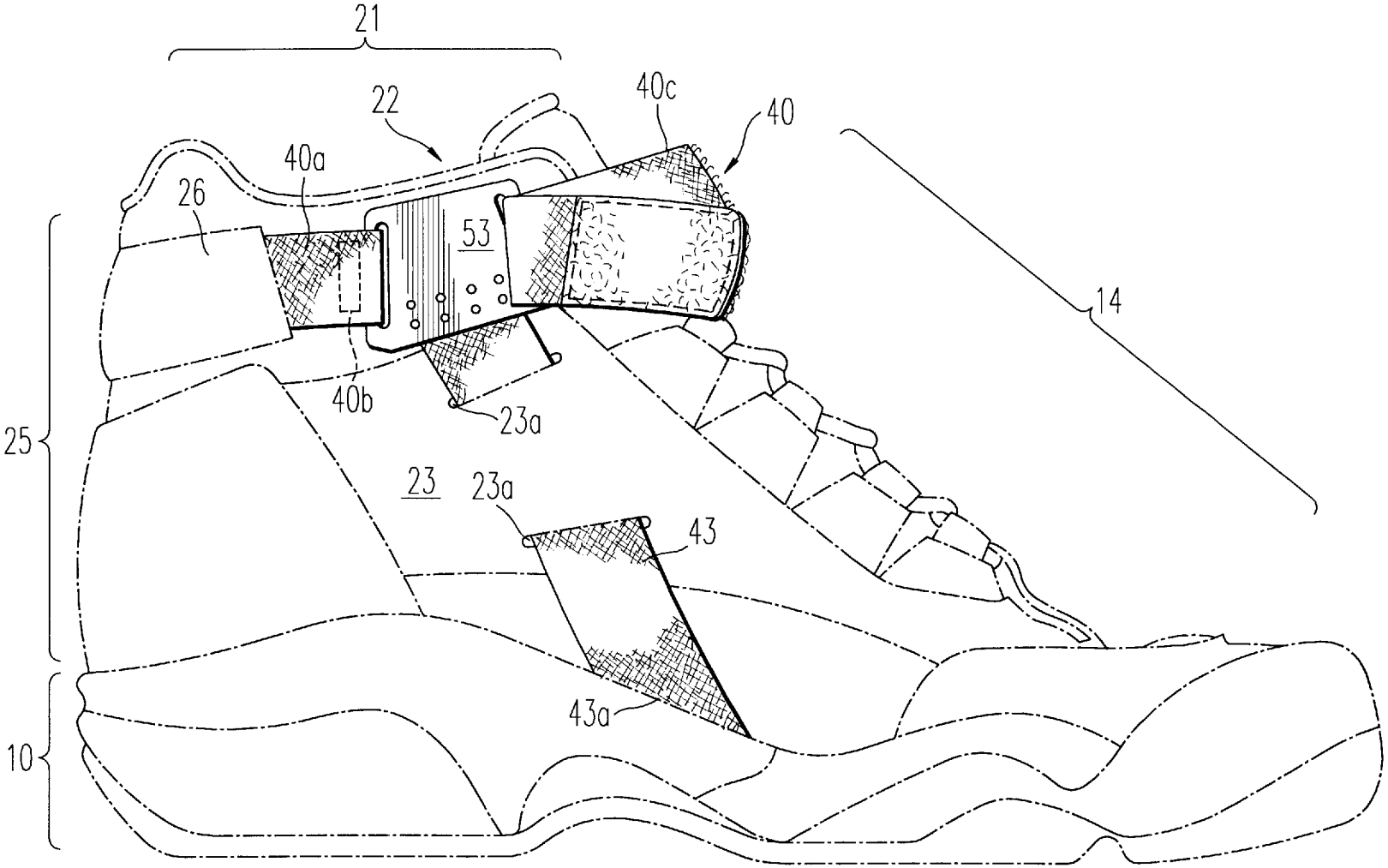
FIG. 2 is a lateral side view of the shoe of FIG. 1.
Figure 3:
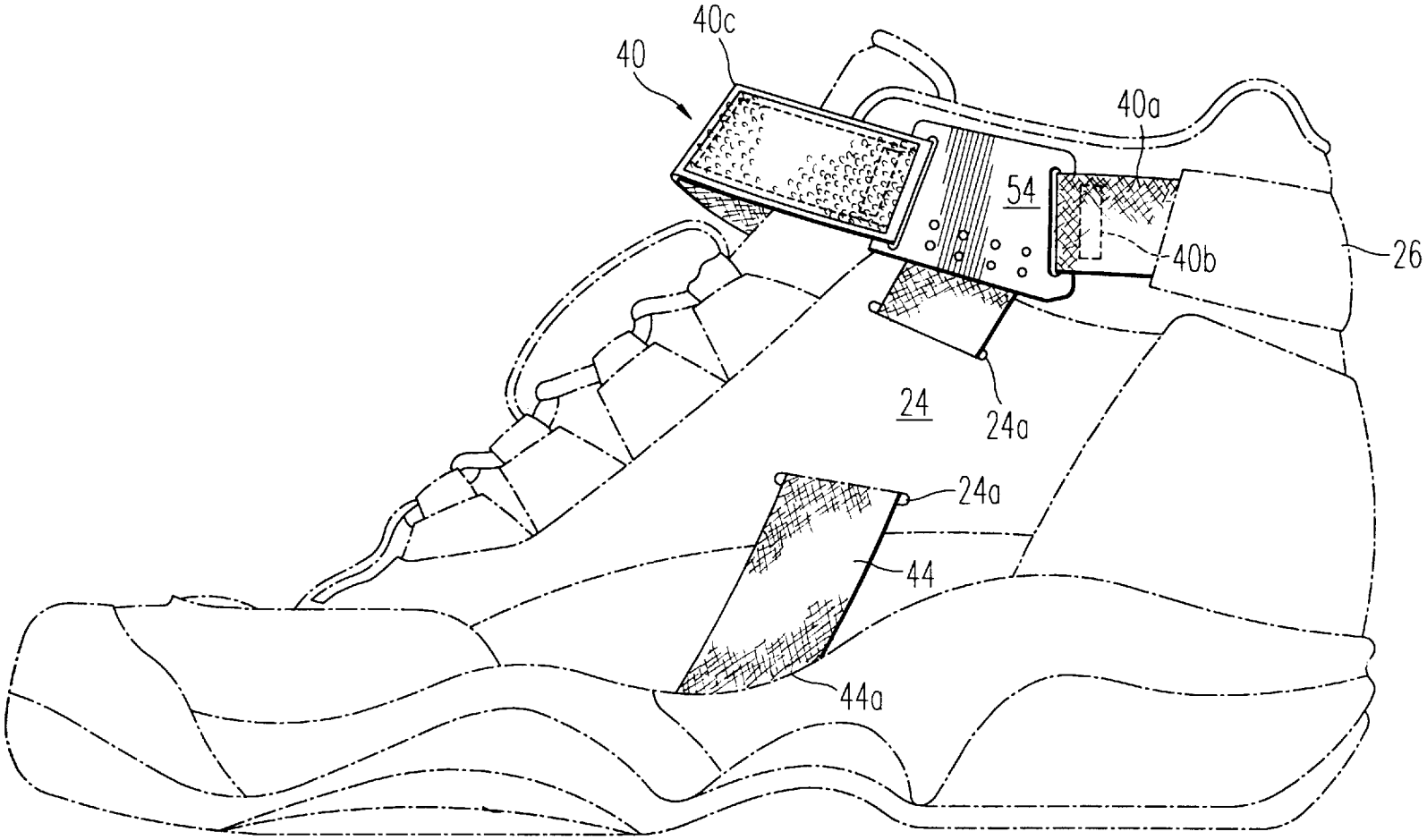
FIG. 3 is a medial side view of the shoe of FIG. 1.

Referring now to the drawings, wherein like reference numerals designate corresponding parts throughout the several views, as shown in FIGS. 1–3, the shoe generally includes a sole portion 10 and an upper 20 connected to the sole portion 10. The sole portion 10 can be of various single or multi-piece constructions, and can include, for example, a lower sole portion and a midsole portion, or a unitary construction, depending upon the type of shoe in which the support strap assembly is utilized. Although an athletic shoe is depicted in the preferred embodiment, it is to be understood that the present invention is also applicable to other types of shoes, such as hiking shoes or boots, or standard or orthopedic street or dress shoes. In addition, although a hightop shoe is shown in the drawings, the present invention is also applicable to a lowtop shoe. While the depicted embodiment provides the upper strap assembly below the top of the shoe, it also may be disposed above the top of the shoe so that the upper strap assembly extends about the leg of the wearer at a location above the shoe.

As shown in FIG. 2, the upper 20 includes a top portion 21 which defines an opening 22 through which a foot is inserted when the shoe is placed on the foot. In addition, the upper includes lateral and medial side portions 23, 24 (FIGS. 2 and 3), and front and rear portions 14, 25 extending along the front and rear portions of the shoe.

As also shown in the drawing figures, the support strap assembly includes an upper support strap assembly 40, and side strap assemblies 43, 44 extending along the lateral and medial sides of the upper. In the depicted embodiment, the side strap assemblies 43, 44 each include a single strap, however, it is to be understood that a multi-strap arrangement may also be utilized.

In a particularly preferred form of the invention, the upper includes an additional piece of leather, fabric, or other material 26 extending about the rear or heel side of the shoe, to define a channel through which the upper strap assembly 40 extends. This arrangement is desirable in maintaining a proper height and/or orientation of the upper strap assembly 40, thus presenting a desired position for the upper strap assembly 40 without relying solely upon the tightness of the upper strap assembly 40 about the wearer's leg. As a result, excessive tightening of the upper strap assembly 40 is not required to reap the advantageous stability provide by the support strap assembly. The channel member 26 is also of assistance in preventing the possibility that loose straps could become caught during running, biking, or other activities.

As also shown in the drawing figures, the side strap assemblies extend through slots 23*a*, 24*a* of the respective sides 23, 24 of the uppers, thereby also assisting in maintaining proper positioning of the side strap assemblies 43, 44, and avoiding undesirable loose straps. Buckle members 53, 54 are associated with each side of the upper strap assembly 40. The buckle members 53, 54 provide a connection between the upper strap assembly 40 and the side strap assemblies 43, 44. In addition, by providing buckle members 53, 54 which are wider than the slots 23*a*, 24*a*, movement of the straps 43, 44 with respect to the slots 23*a*, 24*a* can be limited, even where the upper strap assembly is not fastened or is loosely fastened. Thus, the various features of the present invention provide for proper positioning of the support strap assembly, while minimizing the number of fasteners and adjustments required. Further, the assembly can provide support and balance to the shoe, even if the support strap assembly is lightly fastened or not fastened at all.

In the depicted embodiment, the upper strap assembly 40 includes a first strap member 40*a* which is fastened to the buckle members 53, 54, and which extends through the channel portion 26. The first strap 40*a* can be fastened to the buckles 53, 54, for example, by extending the strap 40*a* through apertures of the buckle members 53, 54 and stitching the strap 40*a* upon itself as identified by broken lines 40*b* in the drawing figures. Of course, other forms of fastening may also be utilized if desired.

The upper strap assembly 40 further includes a second strap or frontal strap member 40*c*. The second strap 40*c* is fastened to one of the buckle members 54, for example, by stitching as discussed earlier. The second strap 40*c* also passes through an aperture of the other buckle member 53, but is not fastened to the other buckle member so that the strap 40*c* can be removed from the buckle member 53 during insertion and removal of a foot from the shoe. The strap 40*c* is fed through the buckle member 53 and utilized for adjusting the tightness of the upper strap assembly 40, and the strap 40*c* can then be folded back upon itself and fastened upon itself, e.g., by a hook and loop fastener provided by mating fastener elements 40*d*, 40*e*. Thus, the support strap assembly of the present invention includes only a single fastening arrangement provided by the hook and loop fastener, while nevertheless providing a support strap assembly which enhances the shoe support and balance even if the strap assembly is improperly fastened.

As also shown in the drawing figures, the side strap assemblies 43, 44 extend obliquely from the upper strap assembly 40, so that the tops of the straps 43, 44 are closer to the heel region of the shoe than the bottoms of the straps 43, 44. As shown in FIGS. 2 and 3, in the depicted embodiment, the bottoms of the straps 43, 44 extend to the sole and meet with the sole at a location 43*a*, 44*a* generally in the arch region of the foot. With this arrangement, the side straps 43, 44 provide for balancing of the foot in a stirrup-like action, resulting in a more stable shoe in which the wearer is provided with feedback indicating the orientation or posture of the foot. More particularly, when the foot is disposed at an angle (ankle inversion or eversion) a pressure or force is provided by the strap on the side of the shoe/foot opposite to the direction in which the foot is turned, to not only provide support to the shoe and foot, but also to provide feedback to the wearer, which can assist the wearer in regaining proper positioning/posture.

The side strap assemblies 43, 44 can be connected to the sole, to a midsole, or between various elements of a sole assembly as desired. It is also to be understood that the orientation and location at which the various straps are provided can also be varied from that of the presently preferred embodiment.

As should be apparent from the foregoing, the support strap assembly of the present invention provides a balanced and stable shoe, in which the number of fasteners is minimized. In addition, the arrangement of the present invention does not require extremely precise fastening or excessive tightening of the strap assembly to provide advantageous balancing, feedback and/or support. Of course, many other objects and advantages of the present invention will be readily apparent to those skilled in the art.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters Patent of the United States is:

1. A shoe having a support strap assembly comprising:

(a) a sole;

(b) an upper connected to said sole, said upper having:

(i) a bottom portion adjacent said sole;

(ii) a top portion defining an opening through which a foot is inserted;

(iii) a rear portion;

(iv) a front portion;

(v) a first side portion on a lateral side of said shoe;

(vi) a second side portion on a medial side of said shoe;

(c) a support strap assembly comprising:

(i) an upper strap assembly adjacent said top portion of said upper;

(ii) a first side strap assembly extending along said first side of said upper, said first side strap assembly connected to said upper strap assembly and extending at an oblique angle with respect to said upper strap assembly; and (iii) a second side strap assembly extending along said second side of said upper, said second side strap assembly connected to said upper strap assembly and extending at an oblique angle with respect to said upper strap assembly;and (d) wherein a slot is disposed on at least one of said first side portion and said second side portion of said shoe and a corresponding one of said first side strap assembly and said second side strap assembly extends through said slot and is connected to said upper strap assembly at a location above said slot.

2. A shoe as recited in claim 1, wherein said at least one slot includes a first slot opening and a second slot opening, and wherein said first side portion of said upper includes said first slot opening and said first side strap assembly includes a strap extending through said first slot opening, and wherein said second side portion of said upper includes said second slot opening and said second side strap assembly includes a strap extending through said second slot opening, and wherein said first and second strap assemblies are respectively connected to said upper strap assembly at locations above said first and second slot openings.

3. A shoe as recited in claim 2, wherein said upper strap assembly includes a first buckle member and a second buckle member, and wherein said first side strap assembly is connected to said first buckle member and said second strap assembly is connected to said second buckle member.

4. A shoe as recited in claim 3, wherein said upper includes a channel through which said upper strap assembly extends.

5. A shoe as recited in claim 4, wherein said channel extends along the rear portion of said upper.

6. A shoe as recited in claim 5, wherein said upper strap assembly includes a first upper strap extending from said first buckle member, about said rear portion of said upper and to said second buckle member; and wherein said upper strap assembly further includes a second upper strap extending from said first buckle member, about said front portion of said upper and to said second buckle member.

7. A shoe as recited in claim 6, wherein said second upper strap is fastened to one of said first and second buckle members, and wherein the other of said first and second buckle members includes an opening through which said second upper strap extends.

8. A shoe as recited in claim 7, wherein said second upper strap includes a hook and loop fastener formed of first and second fastener parts disposed on one side of said second strap, and wherein said second strap passes through said opening and is folded back onto itself such that said first and second fastener parts mate with each other.

9. A shoe as recited in claim 1, wherein said upper strap assembly includes a first buckle member and a second buckle member, and wherein said first side strap assembly is connected to said first buckle member and said second strap assembly is connected to said second buckle member.

10. A shoe as recited in claim 1, wherein said upper includes a channel through which said upper strap assembly extends.

11. A shoe as recited in claim 1, wherein said upper strap assembly includes a fixed length strap extending from a first location at which said first side strap assembly is connected to said upper strap assembly to a second location at which said second side strap assembly is connected to said upper strap assembly, said fixed length strap extending about the rear portion of said shoe such that a length from said first location about said rear portion and to said second location is fixed, and further wherein said upper strap assembly includes an adjustable strap extending from said first location about the front portion of said shoe and to said second location such that a length from said first location about said front portion and to said second location is adjustable.

12. A shoe as recited in claim 11, wherein said first side strap assembly includes a first fixed length strap having a first end fixed to said upper strap assembly and a second end fixed to said shoe, and said second side strap assembly includes a second fixed length strap having a first end fixed to said upper strap assembly and a second end fixed to said shoe.

13. A shoe having a support strap assembly comprising:

(a) a sole;

(b) an upper connected to said sole, said upper having:

(i) a bottom portion adjacent said sole;

(ii) a top portion defining an opening through which said a foot is inserted;

(iii) a rear portion;

(iv) a front portion;

(v) a first side portion on a lateral side of said shoe, said first side portion including a first slot;

(iv) a second side portion on a medial side of said shoe, said second side portion including a second slot;

(c) a support strap assembly having:

(i) an upper strap assembly disposed adjacent said top portion of said upper;

(ii) a first side strap assembly extending along said first side of said upper, said first side strap extending from said upper strap assembly and through said first slot; and (iii) a second side strap assembly extending along said second side of said upper, said second side strap assembly extending from said upper strap assembly and through said second slot; and (d) wherein said upper strap assembly includes first and second buckle members, and wherein said first and second said strap assemblies are, respectively, connected to said first and second buckle members at locations above said first and second slots, and further wherein each of said first and second buckle members has a width larger than a respective width of each of said first and second slots.

14. A shoe as recited in claim 13, wherein said upper includes a channel through which said upper strap assembly extends.

15. A shoe as recited in claim 13, wherein said first strap assembly and said second-strap assembly each extend from said upper strap assembly at an oblique angle with respect to said upper strap assembly, and wherein a top of each of said first and second strap assemblies is disposed closer to said rear portion of said upper than a bottom of each of said first and second strap assemblies.

16. A shoe having a support strap assembly comprising:

(a) a sole;

(b) an upper having first and second side portions and a top portion defining an opening through which a foot is inserted, wherein said first and second side portions respectively have first and second slots;

(c) an upper strap assembly disposed adjacent said opening and encircling a region adjacent said opening, said upper strap assembly including first and second buckle members;

(d) a first side strap assembly connected to said first buckle member at a location above said first slot, said first side strap assembly extending downwardly from said first buckle member and through said first slot; and (e) a second side strap assembly connected to said second buckle member at a location above said second slot, said second side strap assembly extending downwardly from said second buckle member and through said second slot.

17. A shoe as recited in claim 16, wherein each of said first and second buckle members has a width larger than a respective width of each of said first and second slots.

18. A shoe as recited in claim 17, wherein said upper includes a channel through which said upper strap assembly extends.

19. A shoe as recited in claim 16, wherein said first side strap assembly and said second side strap assembly extend to said sole and meet said sole at an arch region of said shoe.

20. A shoe as recited in claim 19, wherein said first side strap assembly comprises a first fixed length strap having a first end fixed to said first buckle member and a second end fixed to said shoe at an arch region of said shoe.

21. A shoe as recited in claim 20, wherein said second side strap assembly comprises a second fixed length strap having a first end fixed to said second buckle member and a second end fixed to said shoe at an arch region of said shoe.

22. A shoe as recited in claim 21, wherein said upper strap assembly includes a first strap, said first strap having a fixed length, and wherein a first end of said first strap is fixed to said first buckle member and a second end of said first strap is fixed to said second buckle member, and wherein said first strap of said upper strap assembly extends from said first buckle member about a rear of said shoe and to said second buckle member and a length of said first strap from said first buckle member to said second buckle member is fixed.

23. A shoe as recited in claim 22, wherein said upper strap assembly further includes a second strap, wherein said second strap is fixed to said first buckle member and is adjustably received by said second buckle member such that a length of said second strap from said first buckle member to said second buckle member is adjustable, and wherein said second strap extends from said first buckle member about a front portion of said shoe and to said second buckle member.

24. A shoe as recited in claim 16, wherein said upper strap assembly includes a first strap, said first strap having a fixed length, and wherein a first end of said first strap is fixed to said first buckle member and a second end of said first strap is fixed to said second buckle member, and wherein said first strap of said upper strap assembly extends from said first buckle member about a rear of said shoe and to said second buckle member and a length of said first strap from said first buckle member to said second buckle member is fixed.

25. A shoe as recited in claim 24, wherein said upper strap assembly further includes a second strap, wherein said second strap is fixed to said first buckle member and is adjustably received by said second buckle member such that a length of said second strap from said first buckle member to said second buckle member is adjustable, and wherein said second strap extends from said first buckle member about a front portion of said shoe and to said second buckle member.

26. A shoe having a support strap assembly comprising:

(a) a sole;

(b) an upper connected to said sole, said upper having:

(i) a bottom portion adjacent said sole;

(ii) a top portion defining an opening through which a foot is inserted;

(iii) a rear portion;

(iv) a front portion;

(v) a first side portion on a lateral side of said shoe;

(vi) a second side portion on a medial side of said shoe; and (c) a support strap assembly comprising:

(i) an upper strap assembly adjacent said top portion of said upper;

(ii) a first fixed length side strap extending along said first side of said upper, said first fixed length side strap having a first end connected to said upper strap assembly at a first location and extending at an oblique angle with respect to said upper strap assembly, said first fixed length side strap having a second end connected to said shoe at a second location, such that a fixed length extends between said first and second locations; and (iii) a second fixed length side strap extending along said second side of said upper, said second fixed length side strap having a first end connected to said upper strap assembly at a third location and extending at an oblique angle with respect to said upper strap assembly, said second fixed length side strap having a second end fixed to said shoe at a fourth location such that a fixed length extends between said third and fourth locations.

27. A shoe as recited in claim 26, wherein said upper strap assembly includes first and second buckle members, and wherein said first end of said first fixed length side strap is fixed to said first buckle member, and wherein said first end of said second fixed length side strap is fixed to said second buckle member.

28. A shoe as recited in claim 27, wherein a first slot is disposed in said first side portion of said shoe and said first fixed length side strap extends through said first slot at a location below said first buckle member, and wherein a second slot is disposed in said second side portion of said shoe and said second fixed length side strap extends through said second slot at a location below said second buckle member.

29. A shoe as recited in claim 28, wherein said upper strap assembly includes a fixed length strap which is fixed to said first and second buckle members and which extends about the rear portion of said shoe such that a length from said first buckle member about the rear portion of said shoe and to said second buckle member is fixed, and wherein said upper strap assembly further includes an adjustable length strap extending from said first buckle member about the front portion of said shoe and to said second buckle member such that a length extend from said first buckle member about the front of the shoe and to said second buckle member is adjustable.

* * * * *